United States Patent [19]

Reisacher

[11] 3,937,183

[45] Feb. 10, 1976

[54] STEAM GENERATOR

[75] Inventor: Raimund Reisacher, Erlangen, Germany

[73] Assignee: Kraftwerk Union Aktiengesellschaft, Mulheim (Ruhr), Germany

[22] Filed: Nov. 19, 1974

[21] Appl. No.: 525,083

[30] Foreign Application Priority Data

Nov. 21, 1973 Germany ..... 2358106

[52] U.S. Cl. ..... 122/34; 122/491

[51] Int. Cl.[2] ..... F22B 1/06; F22B 37/26

[58] Field of Search ..... 122/32, 33, 34, 488, 491

[56] References Cited

UNITED STATES PATENTS

| | | | |
|---|---|---|---|
| 3,242,909 | 3/1966 | Stern et al. | 122/34 |
| 3,298,358 | 1/1967 | Alden, Jr. | 122/34 |
| 3,329,129 | 7/1967 | Sandri | 122/491 X |
| 3,769,781 | 11/1973 | Klein et al. | 122/491 |

*Primary Examiner*—Kenneth W. Sprague
*Attorney, Agent, or Firm*—Kenyon & Kenyon Reilly Carr & Chapin

[57] ABSTRACT

A steam generator having a casing enclosing a U-tube bundle-type heat exchanger, forming hot and cold legs, and above which a group of water separators are positioned to extend above both of these legs, is provided with a means for diverting a portion of the steam-water mixture rising from the hot leg, to the water separators above the cold leg.

6 Claims, 2 Drawing Figures

STEAM GENERATOR

BACKGROUND OF THE INVENTION

A steam generator of the type used in a pressurized-water reactor power plant, commonly comprises a vertical casing having a feed-water inlet and an upper portion of enlarged diameter which on its top forms a steam dome having a steam outlet. In the lower portion of the casing a tube plate forms a closure of the casing, a U-tube bundle having upwardly extending hot and cold legs being mounted in this tube plate, the casing below the tube plate forming a primary header having primary fluid hot and cold nozzles and a partition for directing primary fluid from the hot nozzle through the hot leg and from the cold leg through the cold nozzle. With the reactor's pressurized-water coolant forming the primary fluid, the coolant is delivered from the reactor to the steam generator's hot nozzle, passes through the hot leg of the U-tube bundle and, with a substantial amount of heat removed, goes down through the cold leg and out through the cold nozzle for return to the reactor.

The tube bundle within the casing is circumferentially enclosed by a shroud, the shroud's outside and the inside of the casing being radially interspaced and forming a descent space, the bottom of the shroud being spaced above the tube plate so that the descent space is in flow communication with the inside of the shroud containing the tube bundle. The top of the shroud mounts a group of water separators which extend horizontally above the horizontal extent of the tube bundle, including both of its legs, these water separators being under the steam dome and functioning to separate steam-water mixtures rising from the tube bundle, so that steam is passed into the steam dome while the separated water is guided to the descent space.

The feed water is normally maintained at a level above the top of the tube bundle and, of course, below the tops of the water separators from which the steam discharges. Usually steam dryers are positioned above the water separators and within the steam dome, so that the generator output is dried steam.

The casing of the steam generator is normally cylindrical, the tube bundle shroud is correspondingly cylindrical and the tube bundle itself is generally cylindrical as to its outside contour, each of the two legs having flat interfacing contours forming a vertically extending space or corridor between them which extends up to the tube bends at the top of the tube bundle. The group of water separators are horizontally arranged to form what is, in effect, a cylindrical group with the water separators uniformly interspaced and positioned substantially or approximately concentrically on top of the shroud and with respect to the tube bundle. The various parts are generally symmetrical throughout with respect to each other.

It is desirable that all of the water separators be uniformly loaded during the operation of the steam generator. However, it has been found that because of its higher temperature the hot leg produces steam at a greater rate than the cold leg, the consequence being that the loads under which the water separators positioned above the hot leg must operate, are substantially higher than the load under which the other separators above the cold leg, must operate, even though each of the two legs of the tube bundle are necessarily the same in number and in pitch, because the tube bundle is made up of the individual U-tubes having the return bends.

SUMMARY OF THE INVENTION

The object of the present invention is to provide for a more uniform loading of the water separators of such a steam generator.

According to the invention, this increase in loading uniformity is obtained by providing the steam generator, inside of its casing, with a means for diverting part of the steam-water mixture rising from the hot leg, to at least a portion of the separators positioned above the cold leg. This means may comprise a baffle below the separators and above the hot leg and which is inclined towards the portion of the separators above the cold leg. This baffle can extend in a horizontal direction substantially parallel to the space or corridor formed by the two legs of the tube bundle, and this baffle can be hinged on a line substantially parallel to that space, with the angularity of the baffle made adjustable.

For example, the baffle can be hinged on hinge means extending transversely across the top of the shroud and positioned by the shroud, the water separators being mounted on top of the shroud above this hinged baffle.

BRIEF DESCRIPTION OF THE DRAWINGS

The presently preferred mode for carrying out the invention is illustrated by the accompanying drawings, in which.

DETAILED DESCRIPTION OF THE INVENTION

Figure 2:
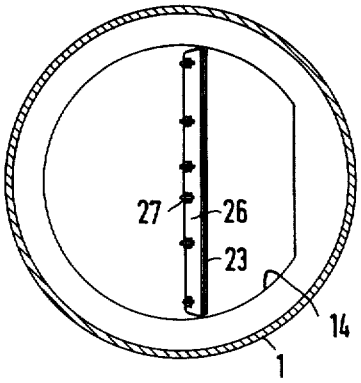
FIG. 2 is a cross section taken on the line II—II in FIG. 1.

In these drawings, the steam generator is shown with its vertical, cylindrical casing 1 having the enlarged upper portion 1*a* and steam dome 1*b*, and containing the U-tube bundle heat exchanger 2 forming the previously described hot leg 3 and cold leg 4, the bottom ends of the two legs having their tubes mounted in the horizontal tube plate 6 below which the casing forms the primary header 7 having the partition 8 which forms the hot manifold 9 of the hot leg 3, and the cold manifold 10 of the cold leg 4, this cold manifold having a primary fluid outlet nozzle 11 and the hot manifold 9 having the primary fluid inlet nozzle 12. When used with a pressurized-water reactor, the reactor coolant goes from the reactor directly into the inlet nozzle 12, discharging from the generator through the outlet nozzle 11 for return to the reactor. The reactor itself and the necessary piping is not shown and may be assumed to be conventional.

The cylindrical shroud 14 is shown as surrounding the tube bundle 2 and forming the descent space 15, the group of water separators mounted on top of this shroud being only generally indicated in outline at 16. However, it is to be understood that the numeral 16 represents a circular group or cluster of individual water separators, for example, as shown by the Webster U.S. Pat. No. 3,766,892, dated Oct. 23, 1973.

In the present instance, dryers 17 are shown above the water separators 16 so that dried steam discharges through the steam output nozzle 18 in the steam dome 1b. In this case the feed water is introduced by an upper feed-water inlet nozzle 19 which, as indicated by the arrow, feeds an annular feed-water injection pipe 20 which is suitably perforated and surrounds the shroud 14 adjacent to the top level of the tube bundle.

In operation, the feed water is adjusted at an appropriate level within the casing, and, heated by the hot and cold legs 3 and 4, rises within the shroud while vaporizing to a steam-water mixture which is separated by the separators 16 to steam which goes to the dryers 17 and out through the output nozzle 18, the separated water being discharged radially outwardly to the space between the outside of the shroud 14 and the inside of the enlarged casing portion 1a, this discharged water descending through the descent space 15 and going back to the inside of the shroud above the tube plate 6, through the annular opening formed by the bottom end of the shroud being spaced above the tube plate 6. A thermo-siphon circulation of the feed-water is thus obtained.

The hot leg 3, which operates at the higher temperature because it receives the reactor coolant directly from the reactor, produces a higher proportion of steam to water than that of the mixture rising from the cold leg 4. With the prior art construction this loads the water separators above the hot leg 3 more than the loading on the water separators above the cold leg 4.

According to the present invention, a horizontal support 23 comprising one side of a hinge extends transversely across the top or upper portion of the shroud 14, substantially parallel to the space 25 between the two legs of the U-tube bundle. As previously explained, this space is essentially flat and represents a division between the two legs which because of the contour of their bundling, forms two flat interspaced surfaces extending vertically and substantially centrally within the tube bundle.

This transverse support 23 is like a hinge, the other side of which supports the flat baffle 26 which is, of course, also in the transverse direction substantially parallel to the space 25. This baffle 26 is adjusted as to its angularity, an adjustment means 27 being illustrated by the drawings. This baffle 26 which extends in a horizontal direction substantially parallel to the space 25, with the baffle ends very close to the inside of the shroud 14, has its pivot point or hinge pin provided by the part 23, positioned slightly offset from the space 25 between the two legs, and, therefore, a little above and outside of the inner extreme of the hot leg 3.

With this new construction, during operation of the generator, the heavier volume of steam arising upwardly inside of the shroud 14 from the hot leg 3, is deflected to the portion of the group of separators 16 above the cold leg 4 and which normally would be more lightly loaded. By varying the angularity of the baffle 26, the load distribution may be adjusted so that to a substantial degree all of the water separators above the two legs, are loaded substantially equally, thus increasing the efficiency of the water separation and, therefore, the overall efficiency of the steam generator.

Figure 1:
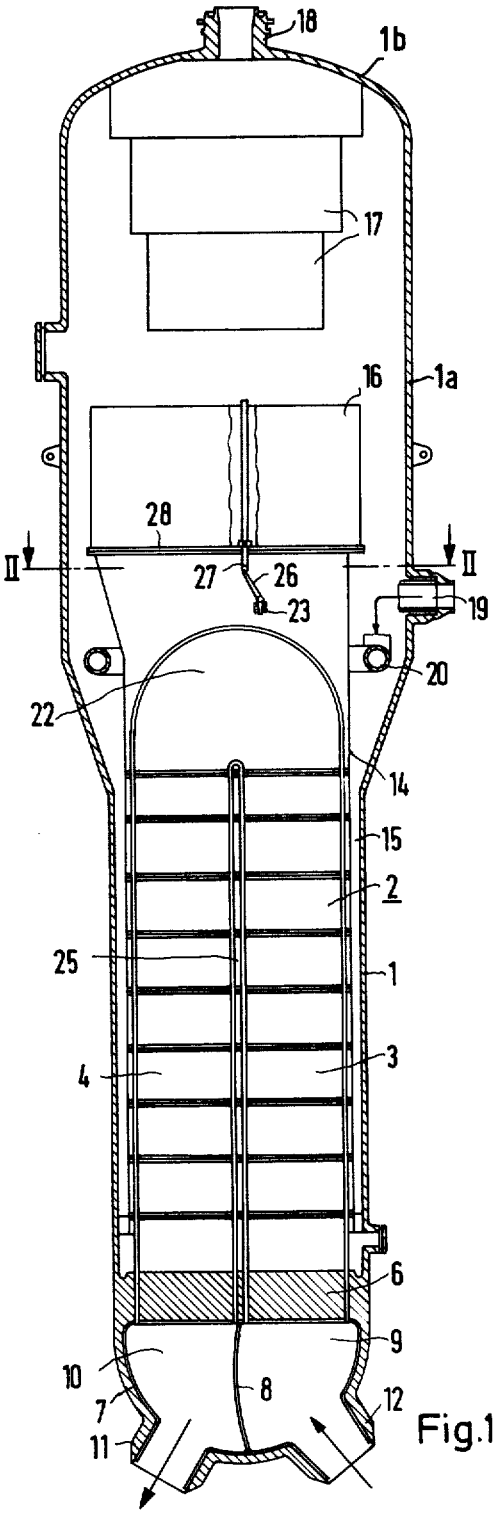
FIG. 1 is a vertical section through a typical steam generator of the type described and to which the invention is applied.

As shown by FIG. 1, the feed-water inlet 19 and its necessary connection (not shown) with the annular feed pipe 20, necessarily occupies some of the room within the casing 1*a* portion, provided by the generally cylindrical shroud 14. This need for pipe-clearance is unnecessary on the opposite side of the steam generator and, therefore, as can be seen from FIG. 1, the shroud 14 may be to some degree asymmetrical with respect to the balance of the generator parts, by being enlarged in a direction opposite from that of the feed-water inlet 19. This, in turn, permits the group of water separators 16 to be extended somewhat asymetrically with respect to the balance of the steam generator parts, also in a direction opposite to that of the feed-water inlet nozzle 19.

Normally the above arrangement would result in the increased number of water separators above the cold leg 4 operating under an exaggerated reduced loading as compared to the loading of those water separators more directly above the hot leg 3. However, with the present invention, the deflector, or vane, or baffle 26, which is angled towards the water separators above the cold leg 4, and the thus enlarged number of water separators above the cold leg, can be more heavily loaded because the steam rising from the hot leg is to a more or less degree, depending on the angularity of the baffle 26, deflected away from the separators above the hot leg, and towards and through the separators above the cold leg of the U-tube bundle.

It is to be understood that in a steam generator of the type disclosed, the steam is produced at a high rate. The steam-flow upwardly from the tube bundle has a high velocity, the water separators normally used being of the centrifugal or cyclone type. Because of the high velocity of the flow upwardly, particularly from the hot leg of the heat exchanger, the baffle or vane 66 need not present a surface area to the flow which is any greater than can be provided by a hinged baffle positioned between the hot tube or bends 22 of the U-tube bundle, and the bottom mounting plate 28 by which the water separators are usually mounted on top of the shroud 14. This mounting plate 28 is normally a flat plate that is perforated to provide entrance of the steam-water mixtures to the multiplicity of water separators which, by centrifugal action, in each instance discharge the separated water to the top of the mounting plate 28 and from which the separated water flows radially outwardly and downwardly to the descent space 15.

What is claimed is:

1. A steam generator comprising a vertical casing having a feed-water inlet and an upper portion forming a steam dome having a steam outlet, said casing forming a portion below said dome, having a tube plate forming a closure and a U-tube bundle having upwardly extending hot and cold legs mounted in said tube plate and a primary header below said tube plate and having primary fluid hot and cold nozzles and a partition for directing primary fluid from said hot nozzle through said hot leg and from said cold leg through said cold nozzle, said tube bundle being circumferentially enclosed by a shroud on top of which a group of water separators extends horizontally above at least substantially the horizontal extent of said tube bundle including both of said legs, said separators being under said steam dome, receiving steam-water mixtures rising from both of said legs inside of said shroud, the shroud and the inside of said casing forming a feed-water descent space to which said separators discharge separated water, said casing containing means for diverting part of the steam-water mixture rising from said hot leg to at least a portion of said separators above said cold leg.

2. The steam generator of claim 1 in which said means comprises a baffle below said separators and above said hot leg and inclined towards said portion of said separators above said cold leg.

3. The steam generator of claim 2 in which said hot and cold legs define a vertically and transversely extending flat space between the legs, and said baffle extends in a horizontal direction substantially parallel to said space.

4. The steam generator of claim 3 in which said baffle is hinged on a line substantially parallel to said space and the angularity of said baffle is adjustable by the baffle swinging on said line.

5. The steam generator of claim 4 in which said baffle is hinged on hinge means extending transversely across said shroud and positioned by the shroud.

6. The steam generator of claim 5 in which said baffle has means for adjusting its angularity.

* * * * *